US010165911B2

(12) United States Patent
Chen

(10) Patent No.: US 10,165,911 B2
(45) Date of Patent: Jan. 1, 2019

(54) ELECTRIC WINDOW CLEANING DEVICE

(71) Applicant: Wen Chou Chen, New Taipei (TW)

(72) Inventor: Wen Chou Chen, New Taipei (TW)

( * ) Notice: Subject to any disclaimer, the term of this patent is extended or adjusted under 35 U.S.C. 154(b) by 0 days.

(21) Appl. No.: 15/622,293

(22) Filed: Jun. 14, 2017

(65) Prior Publication Data

US 2018/0000294 A1 Jan. 4, 2018

(30) Foreign Application Priority Data

Jul. 1, 2016 (TW) ..... 105210029 U

(51) Int. Cl.

| | |
|---|---|
| ***A47L 1/03*** | (2006.01) |
| ***A47L 1/05*** | (2006.01) |
| *A47L 1/09* | (2006.01) |
| *A47L 1/12* | (2006.01) |

(52) U.S. Cl.

CPC *A47L 1/03* (2013.01); *A47L 1/05* (2013.01); *A47L 1/09* (2013.01); *A47L 1/12* (2013.01)

(58) Field of Classification Search

CPC ..... A47L 1/02; A47L 1/03; A47L 1/08; A47L 1/09; A47L 1/095; A47L 1/12; A47L 1/13

USPC ..... 15/103, 220.2

See application file for complete search history.

(56) References Cited

U.S. PATENT DOCUMENTS 3,983,591 A * 10/1976 Ohtaki ..... A47L 1/12 15/103
2004/0216253 A1* 11/2004 Enoch, III ..... A47L 1/02 15/103
2007/0251036 A1* 11/2007 Remer ..... A47L 1/02 15/103
2012/0110759 A1* 5/2012 Seo ..... A47L 1/03 15/103
2013/0014782 A1* 1/2013 Ryu ..... A47L 1/03 134/6

FOREIGN PATENT DOCUMENTS

| | | | |
|---|---|---|---|
| JP | 7-314 | * | 1/1995 |
| JP | 9-224881 | * | 9/1997 |
| WO | 01/00077 | * | 1/2001 |
| WO | 2005/044070 | * | 5/2005 |

OTHER PUBLICATIONS

Partial machine translation of WO 01/00077, Jan. 4, 2001.*

* cited by examiner

*Primary Examiner* — Mark Spisich
(74) *Attorney, Agent, or Firm* — Rosenberg, Klein & Lee

(57) ABSTRACT

An electric window cleaning device includes an operating portion and a wiping portion which are attracted to both sides of a glass of a window by magnets, and are free to move along the glass by virtue of balls. The wiping portion includes a power mechanism and a power supply device. The power mechanism includes an output shaft, a rotary disc and a duster removably fixed to the rotary disc. The power device includes a switch and a battery which are electrically connected to the power mechanism. When the power mechanism is turned on, the output shaft rotates the rotary disc and the duster to clean the outer surface of the glass, as an user moves the operating portion which is attracted to the inner surface of the glass, the wiping portion will also move along the outer surface of the glass to perform cleaning operation.

14 Claims, 2 Drawing Sheets

ELECTRIC WINDOW CLEANING DEVICE

BACKGROUND OF THE INVENTION

1. Field of the Invention

The present invention relates to an electric window cleaning device, and more particularly to an electric cleaning device which can be manually operated in a room to rotatably clean the window with electric power.

2. Description of the Prior Art

In order to solve the inconvenience and danger of cleaning the exterior windows, many different techniques have been introduced, such as the "Window Cleaning Device" disclosed in Taiwan Utility Model Registration No. M300144, the "Interior and Exterior Window Cleaning Device" disclosed in Taiwan Utility Model Registration No. M457518, and the "Window Cleaning System Without Disassembling the Window" as disclosed in Taiwan Patent No. 1508691. Since the techniques disclosed in these patents are beyond the scope of this discussion, further explanation would seem unnecessary.

Among the products that are already in public use, there is a wiper called "Easy-to-Use Glass Wiper", which includes two glass brushes with magnetic discs, and the two glass brushes are magnetically attracted to each other at the interior and exterior of a window. Moving the glass brush on the interior of the window can make the glass brush on the exterior of the window move synchronously, so that the interior and exterior of the window can be cleaned simultaneously.

The abovementioned glass wiper is operated only by hand, the window is cleaned only by the friction force of the two glass brushes sliding through the glass, and the cleaning effect is poor due to the friction force is small. In addition, super magnetic discs must be used in order to make the two glass brushes attached to the window glass by magnetic attraction without falling, plus the contact area of the magnetic discs and the window glass is too big and the magnetic force is excessively strong, which makes the operation strenuous, making it difficult for the glass brushes to slide smoothly through the window glass and make turns.

The present invention has arisen to mitigate and/or obviate the afore-described disadvantages.

SUMMARY OF THE INVENTION

One object of the present invention is to provide an electric window cleaning device which is capable of cleaning the window with power, so as to improve cleaning efficiency.

Another object of the present invention is to provide an electric window cleaning device which is able to easily move along the window and freely turn.

To achieve the above objects, an electric window cleaning device comprises an operating portion including a pedestal, a plurality of magnets and a plurality of balls, wherein the pedestal includes a handle and a bottom surface formed opposite to the handle, the magnets are disposed on the pedestal, the balls partially protrude from the bottom surface of the pedestal and are free to roll along the pedestal; and a wiping portion including a base, a plurality of magnets, a plurality of balls and a power mechanism, wherein the base includes a bottom surface, the magnets are disposed in the base, the balls partially protrude from the bottom surface of the base and are free to roll along the base, the power mechanism is supported on the base, and includes an output shaft for outputting rotational kinetic energy and a rotary disc rotated by the output shaft, a duster is fixed to an outer surface of the rotary disc; wherein the operating portion and the wiping portion are magnetically attracted to each other across a glass of a window by magnetic forces of the magnets and are attracted to an inner surface and an outer surface of the glass, respectively, when the power mechanism is turned on, the output shaft rotates the rotary disc and the duster to clean the outer surface of the glass, as an user moves the operating portion which is attracted to the inner surface of the glass, the wiping portion will move simultaneously along the outer surface of the glass to perform cleaning operation.

The operating portion further includes a connecting member which includes a spherical body and a connecting portion, the pedestal includes a spherical cavity and a cover removably fixed to the pedestal, the spherical body is disposed in the spherical cavity and rollably locked in spherical cavity by the cover, and the connecting portion is formed on an outer surface of the spherical body, inserted through the cover, and provided for connecting a rod.

In another embodiment of the present invention, the electric window cleaning device comprises two wiping portions, each of the wiping portions including a base, a plurality of magnets, a plurality of balls and a power mechanism, wherein the base includes a bottom surface, the magnets are disposed in the base, the balls partially protrude from the bottom surface of the base and are free to roll along the base, the power mechanism is supported on the base, and includes an output shaft for outputting rotational kinetic energy and a rotary disc rotated by the output shaft, a duster is fixed to an outer surface of the rotary disc; wherein the two wiping portions are magnetically attracted to each other across a glass of a window by the magnets and are attracted to an inner surface and an outer surface of the glass, respectively, when the power mechanism is turned on, the output shaft rotates the rotary disc and the dusters to clean the inner and outer surfaces of the glass, as an user moves the wiping portion which is attracted to the inner surface of the glass, the wiping portion attached to the outer surface of the glass will move simultaneously along the outer surface to perform cleaning operation.

Each of the pedestal and the base is further provided with a plurality of receiving holes with a large upper diameter and a small lower diameter, the receiving holes are provided for accommodating the balls, each of the balls is rollably retained in a corresponding one of the receiving holes by a plug screwed in a large-diameter end of the corresponding one of the receiving holes, each of the plugs is provided with a semispherical cavity in one end thereof facing a corresponding one of the balls, and a plurality of small steel balls is disposed between the semispherical cavity and the corresponding one of the balls.

As compared to the prior art, the invention substantially improves the cleaning efficiency by cleaning the window with a duster which is able to clean the window in a rotating manner, so that the window surface can be thoroughly cleaned. Besides, the electric window cleaning device can move and turn freely along the window glass under the action of the balls, so the cleaning operation is easy and labor-saving.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
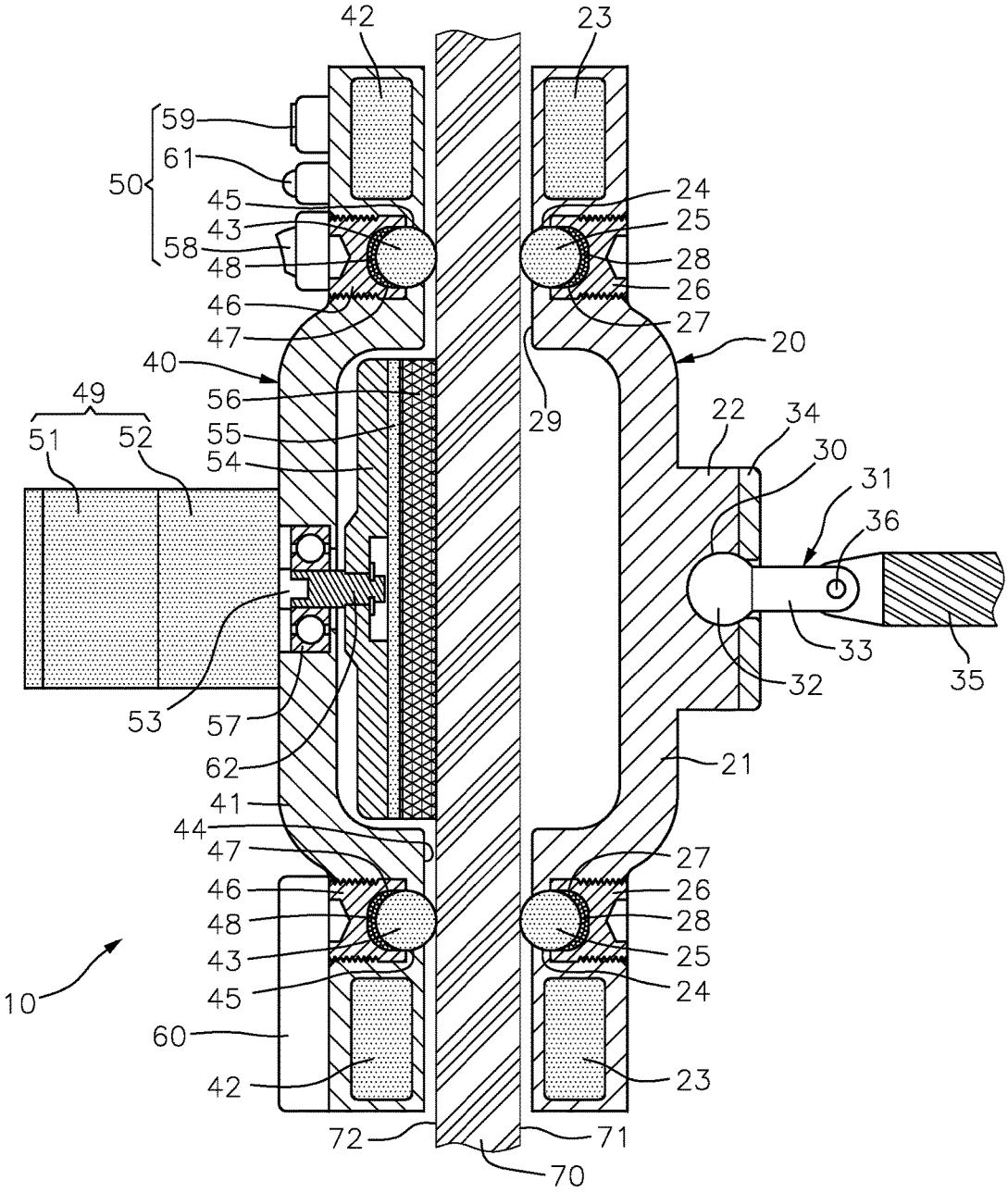
FIG. 1 is a cross sectional view of the invention showing that the electric window cleaning device is attached to the inner and outer surfaces of the glass of the window.

Referring to FIG. 1, an electric window cleaning device 10 in accordance with the present invention comprises an operating portion 20 with a pedestal 21. A handle 22 is formed on the top of the pedestal 21 to facilitate the user to hold the operating portion 20 with one hand. The operating portion 20 further includes a plurality of magnets 23 which are separately embedded at different positions in the pedestal 21, and the purpose of the magnets 23 will be explained later. The pedestal 21 is further provided with a plurality of receiving holes 24 with a large upper diameter and a small lower diameter. Each of the receiving holes 24 is provided for accommodating a ball 25 which is rollably retained therein by a plug 26 screwed in a large-diameter end of a corresponding one of the receiving holes 24, in such a manner that the balls 25 partially protrude from a bottom surface 29 of the pedestal 21 to come into contact with an inner surface 71 of the glass 70 of the window in a point-to-point contact manner, so that the friction force between the operating portion 20 and the inner surface 71 is reduced so as to facilitate the operating portion 20 to slide on the inner surface 71. Besides, each of the plugs 26 is provided with a semispherical cavity 27 in one end thereof facing a corresponding one of the balls 25, and a plurality of small steel balls 28 is disposed between the cavity 27 and the corresponding one of the balls 25. Thus, each of the balls 25 can roll in any direction with the aid of the small steel balls 28 which have the effect of reducing friction, so that the operating portion 20 can move freely along the inner surface 71.

Another important part of this invention is a wiping portion 40 which is magnetically attracted to the operating portion 20 across the glass 70. As shown in FIG. 1, the wiping portion 40 includes a base 41 which is the same as the operating portion 20 and also provided with a plurality of magnets 42 and balls 43 at the corresponding positions, so that the operating portion 20 and the wiping portion 40 can be magnetically attracted to each other across the glass 70 by the magnets 23, 42, and are attracted to the inner surface 71 and an outer surface 72 of the glass 70, respectively. Meanwhile, the balls 25, 43 which protrude respectively from the bottom surface 29 of the pedestal 21 and a bottom surface 44 of the base 41 can roll freely along the inner surface 71 and the outer surface 72 of the glass 70, respectively. In the drawings, the reference number 45 represents the receiving holes, 46 represents the plug, 47 represents the cavities, 48 represents the small steel balls, which are the same as the corresponding elements of the operating portion 20.

The wiping portion 40 further includes a power mechanism 49 and a power supply device 50. The power mechanism 49 includes a motor 51 and a reduction gear box 52. The motor 51 produces a rotational force, and the reduction gear box 52 is connected to the power outputting end of the motor 51 to take the rotational force of the motor 51. The reduction gear box 52 reduces the rotation speed and increases the torque of the motor 51, and then outputs a rotational kinetic energy via an output shaft 53. The output shaft 53 is inserted into a rotary-disc shaft 62 to transmit the rotational kinetic energy to a rotary disc 54 connected to the latter. The rotary-disc shaft 62 is rotatably supported on a bearing 57 fixed to the base 41. A hook and loop fastener (Velcro) 55 is attached to an outer surface of the rotary disc 54, so that a duster 56 whose back surface is also provided with a hook and loop fastener (Velcro, not shown) can be attached to the rotary disc 54 to clean the glass 70 of the window, and the duster 56 can be removed for cleaning or replacement when it becomes dirty or broken after use overtime.

The power supply device 50 includes a switch 58, a socket 59 and a battery 60 which are disposed on the base 41 and electrically connected to the motor 51 to form a loop which will be closed when the switch 58 is On and will be opened when the switch 58 is Off, so as to stop or start the motor 51. The socket 59 is provided for connecting an AC/DC convertor (not shown), so that the battery 60 can be recharged by the AC/DC convertor to supplement the current consumed by the battery 60. Of course, the loop can also be slightly modified to use the convertor to supply current to the motor 51 and recharge the battery 60. In a preferred embodiment, the power supply device 50 further includes a power indicator light 61 which constitutes a part of the loop, and the power indicator light 61 is turned on or off when the switch 58 is On or Off, so as to provide a visual signal to let the user know whether the electric window cleaning device 10 is turned on or not.

As shown in FIG. 1, when the electric window cleaning device 10 is in use, the user should wet the duster 56 and spray cleaner on it, then the operating portion 20 and the wiping portion 40 are magnetically attracted to each other across the glass 70 by the magnets 23, 42, and are attracted to the inner surface 71 and an outer surface 72 of the glass 70, respectively, and then the switch 58 is turned on. When the switch 58 is On, the battery 60 is electrically connected to the circuit of the motor 51 to start the motor 51. The reduction gear box 52 reduces the rotation speed and increases the torque of the motor 51, and then the output shaft 53 drives the rotary disc 54 to rotate via the rotary-disc shaft 62, and as a result, the duster 56 fixed on the rotary disc 54 rotates simultaneously to clean the outer surface 72 of the glass. As the user manually moves the operating portion 20 which is attracted to the inner surface 71 of the glass 70 of the window, the wiping portion 40 attached to the outer surface 72 will also move simultaneously while performing cleaning operation until the entire outer surface 72 is completely cleaned.

Since the duster 56 is driven to rotate by the power mechanism 49, a friction at middle and low speeds will be produced with respect to the outer surface 72 to achieve a quick and efficient cleaning effect. Besides, the operating portion 20 and the wiping portion 40 can maintain a point-to-point contact with the inner and outer surfaces 71, 72 of the glass 70 of the window via the balls 25, 43 which are free to roll in any directions, which substantially reduces the friction resistance of the operating portion 20 and the wiping portion 40 with respect to the glass 70 of the window, so that the electric window cleaning device 10 can easily move on the surfaces of the glass 70 of the window and freely turn, so as to improve work efficiency.

As shown in FIG. 1, the operating portion 20 further includes a connecting member 31 which includes a spherical body 32 and a connecting portion 33. The spherical body 32 is disposed in a spherical cavity 30 of the handle 22, and is retained in a hollow cover 34 of the pedestal 21 and rollably locked in spherical cavity 30 by a retaining member, such as a screw (not shown). The connecting portion 33 is formed on an outer surface of the spherical body 32, inserted through the cover 34, and provided for connecting a rod 35, so that the rod 35 pivoted to the connecting portion 33 by a pivot member 36 can be folded with respect to the connecting member 31. Meanwhile, the connecting member 31 is freely rollable in the spherical cavity 30, so that the rod 35 can be used to move the operating portion 20, and the wiping portion 40 can also be moved in a simultaneous manner, which is convenient for carrying out the cleaning operation of the outer surface 72 of the glass 70 of the window without the help of a chair or a ladder. The rod 35 can be made of a telescopic rod whose length can be varied, or can be made of more than two rods which are connected by joints, so that the user can adjust the length as desired. The connecting member 31 is assembled to the pedestal 21 only when it is necessary to use the rod 35, and can be removed at ordinary times.

Figure 2:
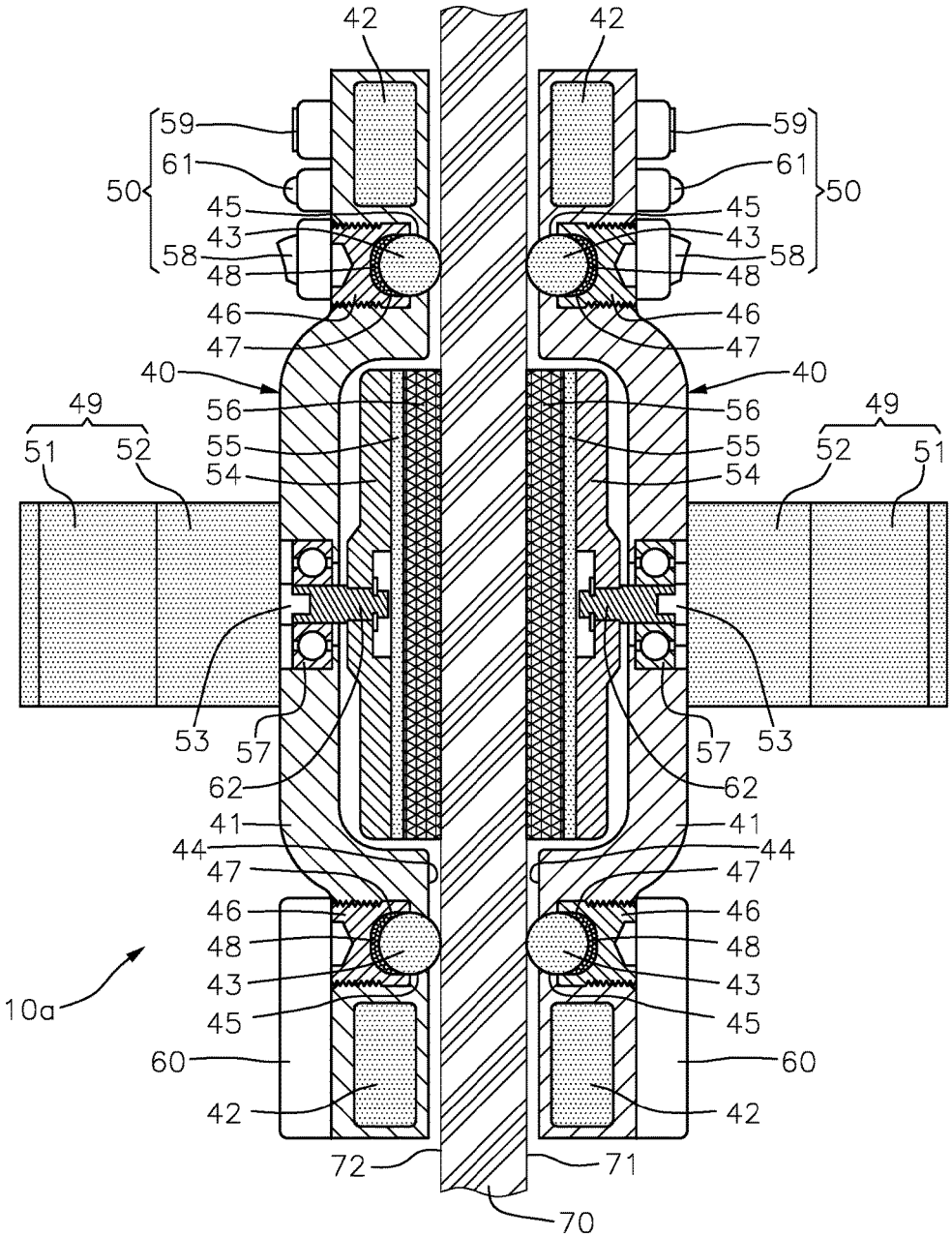
FIG. 2 is a cross sectional of another embodiment of the invention.

The invention is not limited to the abovementioned embodiments and may otherwise be of different forms. For example, as shown in FIG. 2, it can also in the form of the electric window cleaning device 10*a* which is provided with two wiping portions 40 which are attracted to each other across the glass 70 to simultaneously clean the inner surface 71 and the outer surface 72 of the glass 70 of the window.

While we have shown and described various embodiments in accordance with the present invention, it is clear to those skilled in the art that further embodiments may be made without departing from the scope of the present invention.

What is claimed is:

1. An electric window cleaning device, comprising:

an operating portion including a pedestal, a plurality of magnets and a plurality of balls, wherein the pedestal includes a handle and a bottom surface formed opposite to the handle, the magnets are disposed on the pedestal, the balls partially protrude from the bottom surface of the pedestal and are free to roll along the pedestal, the operating portion further including a connecting member which includes a spherical body and a connecting portion, the pedestal including a spherical cavity and a cover removably fixed to the pedestal, the spherical body being disposed in the spherical cavity and rollably locked in the spherical cavity by the cover, and the connecting portion being formed on an outer surface of the spherical body, inserted through the cover, and provided for connecting a rod; and a wiping portion including a base, a plurality of magnets, a plurality of balls and a power mechanism, wherein the base includes a bottom surface, the magnets are disposed in the base, the balls partially protrude from the bottom surface of the base and are free to roll along the base, the power mechanism is supported on the base, and includes an output shaft for outputting rotational kinetic energy and a rotary disc rotated by the output shaft, a duster is fixed to an outer surface of the rotary disc;

wherein the operating portion and the wiping portion are magnetically attracted to each other across a glass of a window by magnetic forces of the magnets and are attracted to an inner surface and an outer surface of the glass, respectively, when the power mechanism is turned on, the output shaft rotates the rotary disc and the duster to clean the outer surface of the glass, as a user moves the operating portion which is attracted to the inner surface of the glass, the wiping portion will move simultaneously along the outer surface of the glass to perform a cleaning operation.

2. The electric window cleaning device as claimed in claim 1, wherein each of the pedestal and the base is further provided with a plurality of receiving holes with a large upper diameter and a small lower diameter, the receiving holes are provided for accommodating the balls, each of the balls is rollably retained in a corresponding one of the receiving holes by a plug screwed in a large-diameter end of the corresponding one of the receiving holes, each of the plugs is provided with a semispherical cavity in one end thereof facing a corresponding one of the balls, and a plurality of small steel balls is disposed between the semispherical cavity and the corresponding one of the balls.

3. The electric window cleaning device as claimed in claim 1, wherein the wiping portion further comprises a power supply device which includes a switch, a battery and a power indicator light which form a loop.

4. The electric window cleaning device as claimed in claim 3, wherein the power supply device further comprises a socket which constitutes a part of the loop, the socket is provided for connecting an AC/DC convertor which is used to recharge the battery or supply power to the power mechanism and recharge the battery.

5. The electric window cleaning device as claimed in claim 1, wherein the power mechanism includes a motor for producing a rotational force, and a reduction gear box connected to a power outputting end of the motor to take the power of the motor, and the reduction gear box reduces a rotation speed and increases a torque of the motor, and then outputs via the output shaft.

6. The electric window cleaning device as claimed in claim 1, wherein the rotary disc is fixed to a rotary-disc shaft which is rotatably supported on a bearing fixed to the base, and the output shaft is inserted in the rotary-disc shaft to transmit rotational motion to the rotary disc via the rotary-disc shaft.

7. The electric window cleaning device as claimed in claim 1, wherein two hook and loop fasteners which are capable of being fastened to each other are attached to the outer surface of the rotary disc and a back surface of the duster, respectively, so that the duster is removably attached to the rotary disc.

8. An electric window cleaning device, comprising two wiping portions, each of the wiping portions including a base, a plurality of magnets, a plurality of balls and a power mechanism, wherein the base includes a bottom surface, a plurality of receiving holes with a large upper diameter and a small lower diameter, the plurality of balls being accommodated in the receiving holes, each of the balls is rollably retained in a corresponding one of the receiving holes by a plug screwed in a large-diameter end of the corresponding one of the receiving holes, each of the plugs is provided with a semispherical cavity in one end thereof facing a corresponding one of the balls, and a plurality of small steel balls is disposed between the semispherical cavity and the corresponding one of the balls, the magnets are disposed in the base, the balls partially protrude from the bottom surface of the base and are free to roll along the base, the power mechanism is supported on the base, and includes an output shaft for outputting rotational kinetic energy and a rotary disc rotated by the output shaft, a duster is fixed to an outer surface of the rotary disc;

wherein the two wiping portions are magnetically attracted to each other across a glass of a window by the magnets and are attracted to an inner surface and an outer surface of the glass, respectively, when the power mechanism is turned on, the output shaft rotates the rotary disc and the dusters to clean the inner and outer surfaces of the glass, as a user moves the wiping portion which is attracted to the inner surface of the glass, the wiping portion attached to the outer surface of the glass will move simultaneously along the outer surface to perform a cleaning operation.

9. The electric window cleaning device as claimed in claim 8, wherein the wiping portion further comprises a power supply device which includes a switch, a battery and a power indicator light which form a loop.

10. The electric window cleaning device as claimed in claim 9, wherein the power supply device further comprises a socket which constitutes a part of the loop, the socket is provided for connecting an AC/DC convertor which is used to recharge the battery or supply power to the power mechanism and recharge the battery.

11. The electric window cleaning device as claimed in claim 8, wherein the power mechanism includes a motor for producing a rotational force, and a reduction gear box connected to a power outputting end of the motor to take the power of the motor, and the reduction gear box reduces a rotation speed and increases a torque of the motor, and then outputs via the output shaft.

12. The electric window cleaning device as claimed in claim 8, wherein the rotary disc is fixed to a rotary-disc shaft which is rotatably supported on a bearing fixed to the base, and the output shaft is inserted in the rotary-disc shaft to transmit rotational motion to the rotary disc via the rotary-disc shaft.

13. The electric window cleaning device as claimed in claim 8, wherein two hook and loop fasteners which are capable of being fastened to each other are attached to the outer surface of the rotary disc and a back surface of the duster, respectively, so that the duster is removably attached to the rotary disc.

14. An electric window cleaning device, comprising:

an operating portion including a pedestal, a plurality of magnets and a plurality of balls, wherein the pedestal includes a handle and a bottom surface formed opposite to the handle, the magnets are disposed on the pedestal, the balls partially protrude from the bottom surface of the pedestal and are free to roll along the pedestal; and a wiping portion including a base, a plurality of magnets, a plurality of balls and a power mechanism, wherein the base includes a bottom surface, the magnets are disposed in the base, the balls partially protrude from the bottom surface of the base and are free to roll along the base, the power mechanism is supported on the base, and includes an output shaft for outputting rotational kinetic energy and a rotary disc rotated by the output shaft, a duster is fixed to an outer surface of the rotary disc;

wherein the operating portion and the wiping portion are magnetically attracted to each other across a glass of a window by magnetic forces of the magnets and are attracted to an inner surface and an outer surface of the glass, respectively, when the power mechanism is turned on, the output shaft rotates the rotary disc and the duster to clean the outer surface of the glass, as a user moves the operating portion which is attracted to the inner surface of the glass, the wiping portion will move simultaneously along the outer surface of the glass to perform a cleaning operation; and wherein each of the pedestal and the base is further provided with a plurality of receiving holes with a large upper diameter and a small lower diameter, the receiving holes are provided for accommodating the balls, each of the balls is rollably retained in a corresponding one of the receiving holes by a plug screwed in a large-diameter end of the corresponding one of the receiving holes, each of the plugs is provided with a semispherical cavity in one end thereof facing a corresponding one of the balls, and a plurality of small steel balls is disposed between the semispherical cavity and the corresponding one of the balls.

* * * * *